United States Patent [19]

Imamura

[11] 4,331,259

[45] May 25, 1982

[54] APPARATUS FOR CONTROLLING DISCHARGE OF LIKE ARTICLES FROM A PLURALITY OF CONTAINERS

[75] Inventor: Yoshiyuki Imamura, Tokyo, Japan

[73] Assignee: Laurel Bank Machine Co., Ltd., Tokyo, Japan

[21] Appl. No.: 94,116

[22] Filed: Nov. 13, 1979

[30] Foreign Application Priority Data

Nov. 17, 1978 [JP] Japan ..... 53-142084

[51] Int. Cl.[3] ..... G07F 11/12

[52] U.S. Cl. ..... 221/11; 221/197

[58] Field of Search ..... 221/10, 11, 14, 103, 221/107–112, 114, 90, 197, 198, 13

[56] References Cited

U.S. PATENT DOCUMENTS

| | | | |
|---|---|---|---|
| 2,889,074 | 6/1959 | Reynolds | 221/108 |
| 3,128,013 | 4/1964 | Holstein et al. | 221/110 X |
| 3,184,034 | 5/1965 | Stuller et al. | 221/13 X |
| 3,203,588 | 8/1965 | O'Neal | 221/114 X |
| 3,355,065 | 11/1967 | Moe | 221/90 |
| 3,608,776 | 9/1971 | Moe et al. | 221/90 |

*Primary Examiner*—F. J. Bartuska

*Attorney, Agent, or Firm*—Fleit & Jacobson

[57] ABSTRACT

In an apparatus for discharging a number of articles from a plurality of containers one after another by unlocking the doors for the containers by means of series of actuators, a mechanism for automatically resetting the actuators to their original positions in preparation for their next unlocking operation. The actuators are rotatable about their axes and are interlocked with each other with their actuating points being offset by a selected angle from each other, the selected angle being amount obtained by dividing 360° by the number of the containers. The actuators are rotated the selected angle at a time. When the last actuator has unlocked the door for the last container, all the actuators automatically return back to their original angular positions.

6 Claims, 5 Drawing Figures

(a)

APPARATUS FOR CONTROLLING DISCHARGE OF LIKE ARTICLES FROM A PLURALITY OF CONTAINERS

BACKGROUND OF THE INVENTION

This invention relates to an apparatus for automatically discharging article used for money-exchanging machines, automatic article vending machines or the like.

Large-sized money-changing machines, for example, installed in banks and the like, as a rule, incorporate therein an apparatus for automatically discharging packaged coins. In a known automatic money-exchanging machine, there are set a plurality of vertical containers which contain therein a number of packages of coins and are arranged in a side-by-side alignment. The bottom opening of each container is covered by a door which is normally locked in its closed position for holding the packages of coins within the container. At the time of discharging articles, the doors are unlocked by means of motor driven unlocking members which are moved in a horizontal direction to come into contact with the doors to unlock them thereby to permit the articles to get out of the containers. In such a conventional mechanism, however, there is an inconvenience that, after the door for the last container in the arrangement has been unlocked, it is necessary to reverse the motor in order to return the unlocking members back to their original positions.

SUMMARY OF THE INVENTION

It is, therefore, an object of the invention to provide an apparatus for discharging articles one after another out of a plurality of containers, wherein, when the door for the last container has been unlocked, all the actuators, which serve to unlock the doors, automatically reset their original positions.

According to the invention, in an apparatus for discharging articles which includes a plurality of containers disposed in a predetermined arrangement, each of the containers containing therein a number of articles to be discharged, and doors which are normally locked in position for covering the bottom openings of the containers to hold the articles within the container, there are provided a series of actuators which are disposed at positions corresponding to the doors, respectively, are rotatable about their axes and are driven by driving means to unlock the doors to permit their opening one after another according to the arrangement of the containers. The actuators are inerlocked with one another with their actuating points being offset in a selected angle from one another. Thus, when the door for the last container in the arrangement has been unlocked, all the actuators automatically return back to their original angular positions.

DESCRIPTION OF THE DRAWINGS

Other objects and advantages of the present invention will become apparent from the following description made with reference to the accompanying drawings, in which.

DESCRIPTION OF THE PREFERRED EMBODIMENT

One embodiment of the present invention will now be described in detail with the reference to the accompanying drawings.

Figure 1:
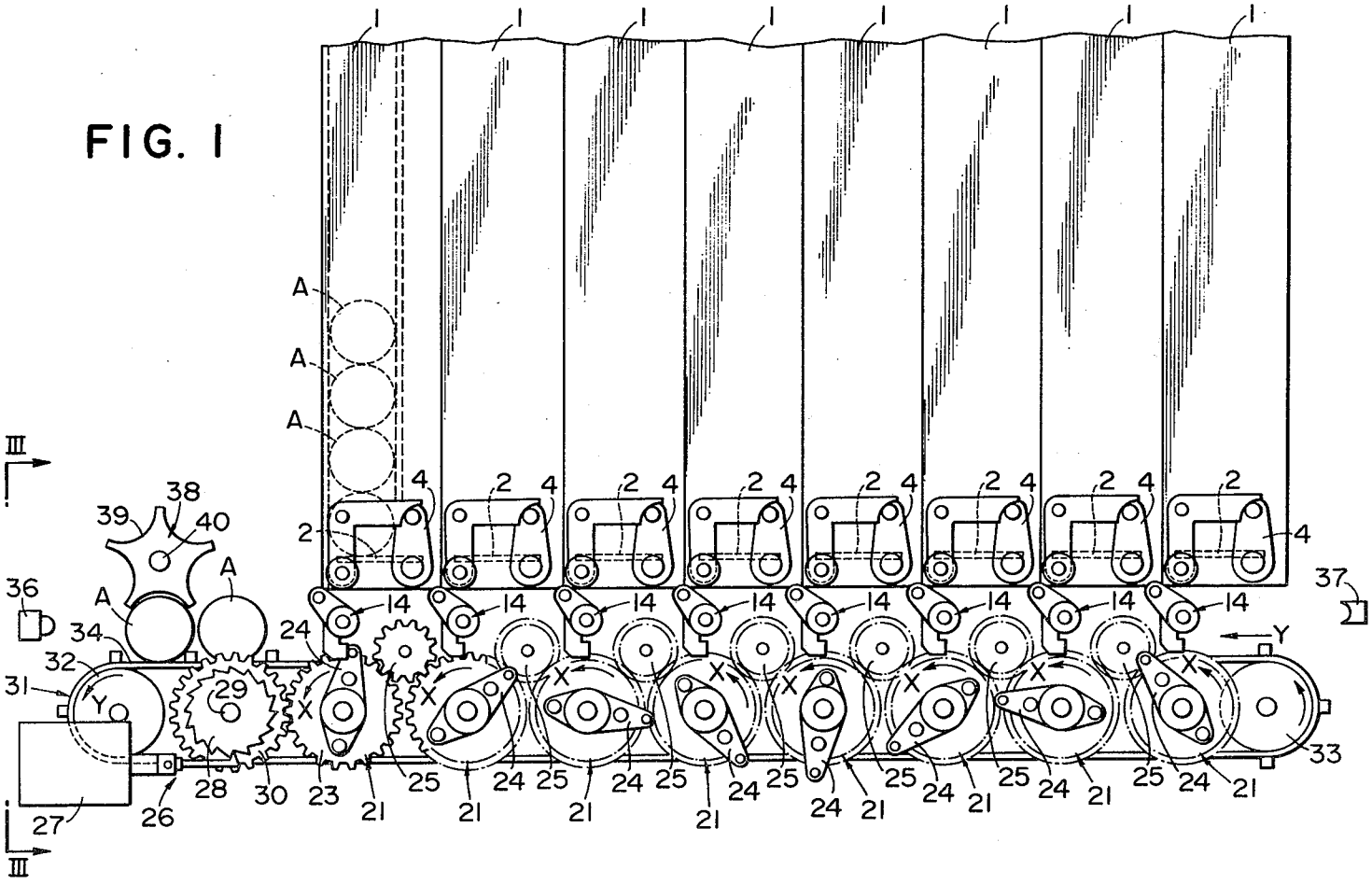
FIG. 1 is a side view schematically illustrating an embodiment of the invention.
Figure 2:
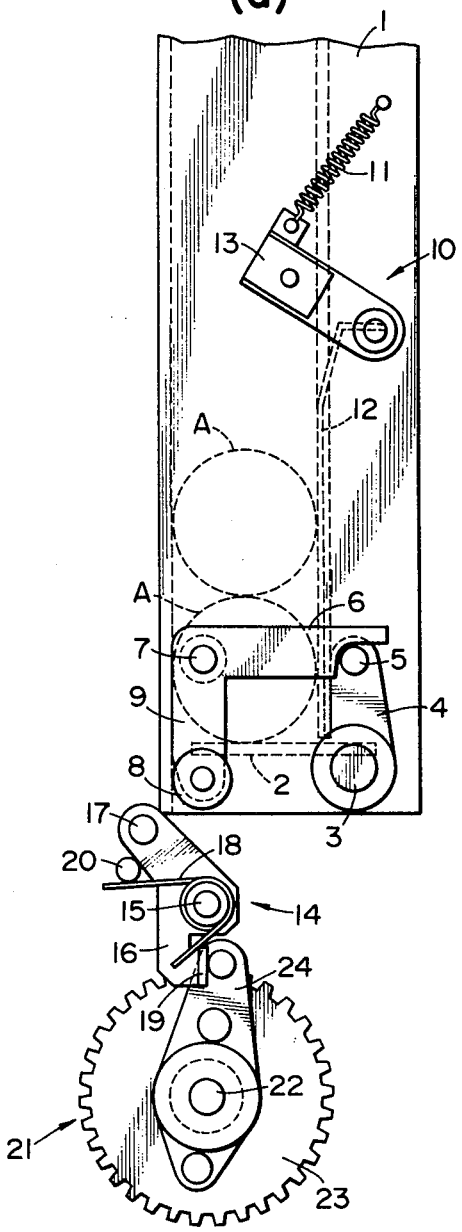
FIGS. 2 (*a*) to (*c*) are fragmentary side views showing various operational stages of the embodiment of FIG. 1.
Figure 2B:
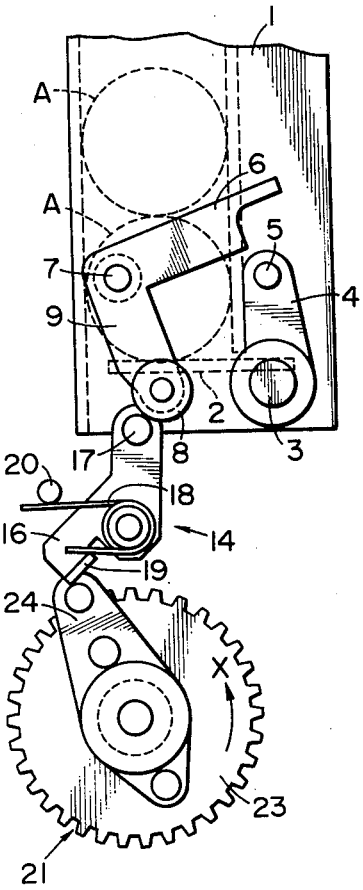
Figure 2C:
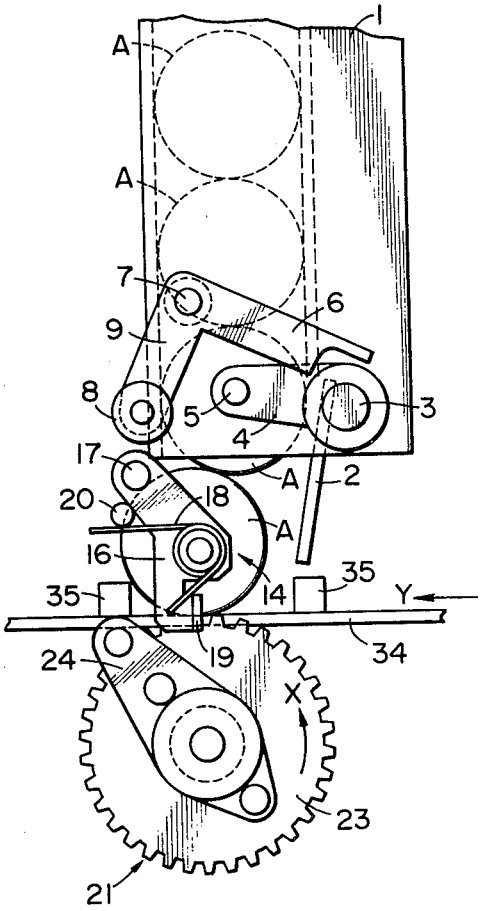

Referring to the drawings, particularly to FIGS. 1 and 2, reference numeral 1 indicates a plurality of elongated vertical containers which are detachably set in the frame (not shown) of an article discharging machine in a side-by-side alignment. Each container 1 contains therein a number of articles A, for example, packages of coins, which are stacked one above another. In the illustrated embodiment, there are shown eight containers 1, and packages of coins will be taken as an example of the articles A. Provided in the bottom opening of each container is an openable door 2 which is mounted for rotation about a shaft 3. The door 2 is normally held at its closed position to prevent the packages of coins A from dropping out of the container 1. The shaft 3 rotatably supports a swing arm 4 which is so formed that it swings integrally with the openable door 2. The arm 4 has on its free end portion a locking pin 5 projecting therefrom. The shaft 3 is provided with a spring (not shown) for urging the door 2 toward its closed position. Provided in the lower portion of the container 1 is a locking arm 6 which is rotatably supported by a shaft 7 and is normally, at its free end, in locking engagement with the pin 5 for preventing the door from swinging downwardly. The arm 6 has a branch arm 9 which is integral with the arm 6 and extends downwardly at a generally right angle to the arm 6. The branch arm 9 has a roller 8 mounted on the free end portion of the arm. Provided also in the container 1 is a detection device, generally indicated by reference numeral 10, for detecting whether all of the packages of coins A have been discharged out of the container 1. The detection device 10 is so designed that, when all the packages A have been discharged from the container 1, a detection plate 12 is rotated clockwisely by the tensile force of a spring 11 to operate a switch 13, whereby a discharge termination signal is issued from the switch 13 to a solenoid 27, to be described hereinafter.

Provided under each of the containers 1 is a release device, generally indicated by reference numeral 14, which is adapted to rotate the branch arm 9 by pushing the roller 8, thereby to release the arm 4 from locking. In the embodiment, there are eight devices 14 for eight containers 1. The release device 14 comprises a swing member 16 which is mounted for rotation about a shaft 15 and has a release pin 17 mounted on one free end portion thereof for the purpose of pushing the roller 8, a torsion coil spring 18 mounted around the shaft 15, a holder portion 19 formed on the other free end of the swing member 16 for holding one end portion of the spring 18, and a stopper 20 which is mounted on the frame of machine to hold the other end portion of the spring 18 and also is adapted to limit rotation of the swing member 16.

Provided under each release device 14 is an actuator assembly, generally indicated by reference numeral 21, for rotating the swing member 16. There are eight assemblies 21 for eight release devices 14. The actuator assembly 21 comprises a gear 23 mounted for rotation about a shaft 22, and an actuating member 24 which is secured to the gear 23 for rotation together with the gear 23 thereby to drive the swing member 16. Eight acutuating members 24 on the gears 23 of the eight actuating assemblies 21 are in such relative angular positions that each member 24 is one-eighth revolution, i.e. 45°, in advance of the preceding one, as shown in FIG. 1. The adjacent gears 23 are operatively interconnected to each other through an idle gear 25 interposed therebetween, and thus the eight actuating members 24 are simultaneously rotated in the same direction with their angular positions being offset by one-eighth revolution. The gear 23 of the leftmost actuator assembly 21 meshes with a driving gear 30 which is mounted for rotation about a shaft 29. The driving gear 30 has a concentric ratchet 28 secured thereto. A driving device, generally indicated by reference numeral 26, is operatively connected to the ratchet 28. The driving device 26 is actuated by the solenoid 27 to drive the ratchet 28 one-eighth revolution at a time.

Also provided under the containers 1 is a conveyor system, generally indicated by reference numeral 31, for conveying packages of coins A to a discharge port (not shown). The conveyor system 31 comprises a driving roller 32 which is driven by a driving motor (not shown), a driven roller 33, and a conveying belt 34 which runs along the bottom faces of the eight containers 1 and around the rollers 32 and 33 for conveying packages A to the discharge port. The belt 34 has on its outer surface projections 35 arranged at intervals of a pitch which is a little larger than the diameter of the package A. Provided above the driving roller 32 and the driven roller 33 of the conveyor system 31 are a light-emitting element 36 and a light-receiving element 37, respectively, in a face-to-face alignment. The elements 36 and 37 are adapted, in cooperation with each other, to detect whether there is any package A carried on the belt 34 or not, and to stop discharging operation of the machine when no package on the belt is detected.

Figure 3:
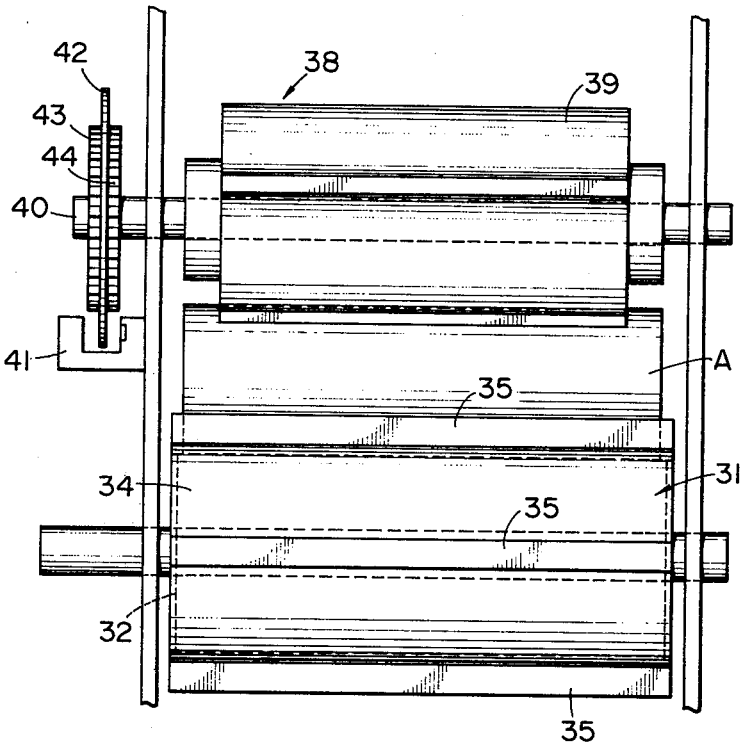
FIG. 3 is an end view as viewed in the direction of arrows III—III in FIG. 1, showing the counting device.

Provided above the left-hand portion of the conveyor system 31, i.e., the left-hand portion of the belt 34 wherefrom packages of coins A are to be sent out of the machine, is a counting device, generally indicated by reference numeral 38, for counting the number of the packages A which are sent to the discharge port. The counting device 38 comprises a generally star-shaped detection plate 39 mounted for rotation about a shaft 40. The plate 39 is so disposed that it is rotated a predetermined angle by every package A passing there. Mounted also to the shaft 40 is a disk 42 which has concentric ratchets 43 and 44 secured on the opposite sides thereof for preventing the detection plate 39 from free or unrestrained clockwise and counterclockwise rotations. Such rotation of the disc 42 is detected by a sensor 41 (FIG. 3), and detection signals are generated for performing counting. The ratchet 43, which is adapted to be normally locked to prevent unrestrained clockwise rotation of the plate 39, can be released from locking by a discharge signal from a control section (not shown) to permit rotation of the detection plate 39, and be maintained in the unlocked state until discharge of a predetermined number of packages of coins A is completed.

While, in the above-described construction, the gears 23 and the idle gears 25, each meshing with the adjacent two gears 23, are employed for the interlocking operation, the interlocking mechanism is not limited to this. For example, sprockets and chains which operatively connect the sprockets may be employed in place of the gears 23 and the driving gear 30 thereby to drive the actuating members 24.

In operation, first, the containers 1, each containing therein a number of packets of coins A, are set in the frame of a money-exchanging machine. Discharge instruction signal from the control section is put in the solenoid 27 of the driving device 26 and also in the counting device 38 to release the ratchet 43 from locking. Upon receiving this discharge instruction signal, the solenoid 27 is energized to rotate the ratchet 28 one-eighth revolution. This revolution is transmitted to the gears 23 of the respective actuator assemblies 21 through the idle gears 25, whereby the respective gears 23 and accordingly their actuating members 24 are rotated one-eighth revolution in the directions of arrows X. Upon this, the swing member 16 of the release device 14 corresponding to the first container 1 (hereinbelow, for convenience sake, the containers 1 will be referred to a of the first, second, . . . , eighth beginning from the one nearest to the discharge port, i.e., from the left to the right in FIG. 1) is driven clockwise by the actuating member 24 of the first actuator assembly 21 (the actuator assemblies 21 will be referred to as of the first, second, . . . , eighth in the same manner as for the containers 1 hereinbelow) thereby to permit the door 2 for the first container 1 to open. More particularly, when the swing member 16 is driven clockwise, the release pin 17 of this swing member 16 drives the corresponding branch arm 9 and accordingly rotates the corresponding locking arm 6 counterclockwisely, by whereby the locking pin 5 of the corresponding swing arm 4 is released from locking. With this locking pin 5 being unlocked, the door 2 for the first container 1 is, by the weight of the packages of the coins A contained in this container 1, rotated counterclockwisely to be opened, as seen in FIG. 2. Accordingly, the packages A drop down in succession from the container 1 onto the belt 34 of the conveyor system 31 which is running in the direction of arrow Y by means of the driving motor, one package A being placed in one interval or space between the adjacent projections 35 on the belt 34. These packages A then pass the counting device 38 one after another, and their number is counted by the counting device 38. More particularly, the detection plate 39 of the counting device 38 is rotated one-fifth revolution, in the illustrated embodiment, every package A, and disk 42 is rotated the same number of revolutions as that of the plate 39, whereby detection signals are sent from the sensor 41 to the control section for taking the count. When the packages A have been counted up to a predetermined number, the ratchet 43 of the counting device 38 is locked, and the driving motor for the conveyor system 31 is stopped.

When all the packages of coins A contained in the first container 1 have gone out, the detection plate 12 of the detection device 10 in the first container 1 is rotated clockwisely by the tensile force of the spring 11 to operate the switch 13, and a discharge termination signal from the switch 13 is put in the solenoid 27 of the driving device 27. By this, the solenoid 27 operates in the similar manner as the above to rotate the actuating members 24 of the respective actuator assemblies 21 one-eighth revolution. As a result, the actuating member 24 of the second actuator assembly 21 drives the release device 14 corresponding to the second container 1, and accordingly the door 2 for the second container 1 is opened in the similar manner as described above in connection with the first container 1, and the packages of coins A contained in the second container 1 drop onto the belt 34 of the conveyor system 31 and are sent to the discharge port.

In such a manner, packages of coins A are discharged out from the first, second, . . . , seventh containers by rotation. Then, when the door 2 for the eighth container 1, i.e. the last container, is opened by the eighth actuator assembly 21, the actuating member 24 of the first actuator assembly 21 takes its original angular position, i.e., the position where another one-eighth counterclockwise revolution of this member 24 unlocks the door 2 for the first container 1. Similarly, the actuating members 24 of the remaining actuator assemblies 21 take their original angular positions as shown in FIG. 1.

Even when all the packages of coins A have been discharged out of the eighth container 1, as long as there exists any package A on the belt 34 of the conveyor system 31, the light from the light-emitting element 36 to the light-receiving element 37 is intercepted, and accordingly no discharge termination signal is put out from the light-receiving element 37 and, therefore, the conveyor system 31 continues its conveying operation. When all of the packages A on the belt 34 have been discharged out of the belt 34, the light-receiving element 37 can receive the light from the light-emitting element 36, and the machine stops its operation in response to a discharge termination signal from the element 37.

The detection device 10 provided in the eighth container 1 is so designed that the discharge termination signal from the switch 13 of this device 10 may not be put in the solenoid 27 of the driving device 26.

While the above description has been made taking by way of example a money-exchanging machine, it is apparent that the invention can be applied to various machines for discharging in succession a plurality of articles of like configuration.

As will be understood from the above, according to the invention, when the door of the last container is opened, all the actuating members automatically return to their original angular positions, and accordingly, by simply replacing the emptied containers with new containers loaded with new articles, operation of discharging articles can immediately be started.

While, in the above, description has been made in connection with the preferred embodiment of the invention, the invention is not limited to this, and it should be understood that various changes and modifications can be made without departing from the spirit and the scope of the invention.

What is claimed is:

1. An article discharging apparatus wherein the apparatus accommodates therein a plurality of containers removably mounted in the apparatus, the containers containing therein articles to be discharged and being disposed in a predetermined arrangement and including doors closing bottom openings of the containers, means for locking the doors in closed positions to hold the articles within the containers, said apparatus comprising:

a series of actuators rotatable about axes and disposed outside of the containers at positions corresponding to said doors, respectively, for unlocking said means for locking the doors one after another according to said arrangement so that articles in the containers are discharged therefrom, said actuators being movable from initial angular positions and interlocked with each other with their actuating points being offset by a selected angle from each other;

means for discharging outside of the apparatus articles discharged from the containers;

means for driving said actuators to rotate whereby, when the door for the last container in said arrangement has been unlocked, all the actuators automatically return to their initial angular position; and means for sensing discharge of the last article from a container and for generating a control signal after discharge of the last article, said means for driving being responsive to said control signal to rotate said actuators through an angular distance equal to said selected angle.

2. An apparatus according to claim 1 wherein each of said actuators comprises a gear which is interlocked with the gear of the adjacent actuator through an idle gear interposed therebetween, and an actuating member secured to said gear for unlocking the means for locking the door for the corresponding container.

3. An apparatus according to claim 2 or 1 wherein said driving means drives said actuators to rotate actuating members of said actuators by a selected angle at time.

4. An apparatus according to claim 3 wherein said selected angle is equal to an amount obtained by diving 360° by the number of the containers.

5. An apparatus according to claim 1 wherein said selected angle is equal to an amount obtained by dividing 360° by the number of the containers.

6. An apparatus according to claim 1, wherein said means for discharging comprises a transfer belt for receiving articles thereon from said containers and for transferring the same, drive means comprising a drive roller and a driven roller for driving the transfer belt, which passes around the drive roller and the driven roller; and means comprising a light emitter and a light receiver disposed above the transfer belt on opposite ends thereof for detecting the presence of articles on the transfer belt.

* * * * *